United States Patent [19]

Propst et al.

[11] 4,052,564

[45] Oct. 4, 1977

[54] MASKING SOUND GENERATOR

[75] Inventors: Robert L. Propst, Ann Arbor; Michael A. Wodka, Ypsilanti, both of Mich.

[73] Assignee: Herman Miller, Inc., Zeeland, Mich.

[21] Appl. No.: 614,917

[22] Filed: Sept. 19, 1975

[51] Int. Cl.[2] ..... H04K 1/00

[52] U.S. Cl. ..... 179/1.5 M; 181/153; 181/199; 179/1 AA; 179/1 E; 312/7 R

[58] Field of Search ..... 179/1.5 R, 1.5 M, 1 E, 179/1 CN, 1 AA; 181/153, 156, 199; 312/7 R; D56/4 B

[56] References Cited

U.S. PATENT DOCUMENTS

| | | | |
|---|---|---|---|
| 3,026,955 | 3/1962 | Wilber | 181/153 |
| 3,213,199 | 10/1965 | Snow | 179/1.5 M |
| 3,371,742 | 3/1968 | Norton et al. | 181/153 |
| 3,476,880 | 11/1969 | Flanagan | 179/1.5 R |
| 3,486,578 | 12/1969 | Abarino | 181/153 |
| 3,497,623 | 2/1970 | Todd | 179/1.5 M |
| 3,541,258 | 11/1970 | Doyle et al. | 179/1.5 M |
| 3,879,578 | 4/1975 | Wildi | 179/1.5 M |
| D. 196,679 | 10/1963 | Schaffer | D56/4 B |

OTHER PUBLICATIONS

Review of Harman-Kardon Citation 13 Speaker System, *Audio*, May 1972, pp. 69–71.

*Primary Examiner*—Howard A. Birmiel
*Attorney, Agent, or Firm*—Olsen and Stephenson

[57] ABSTRACT

Masking sound generating apparatus for use in a conventional room enclosure occupied by adult persons of average range of heights comprising a hollow enclosure having a top opening and a side opening, a speaker mounted inside the enclosure intermediate the top opening and the side opening and facing outwardly from the apparatus through the top opening, and a circuit in the enclosure operable to develop an electric signal which is converted to an audible sound signal emitted by the speaker. Modulation means are incorporated into the circuit to cyclically vary the amplitude of the sound signal which provides the masking sound signal with a pleasant, natural sound characteristic. The sound generating apparatus is located in the room at a height intermediate the head of a standing adult person and the ceiling, and is positioned so that the speaker faces in an upwardly direction to direct sound signals toward the ceiling. Other sound signals produced by the speaker eminate from the side opening to provide the masking sound with a slight undertone characteristic.

9 Claims, 7 Drawing Figures

FIG. 1
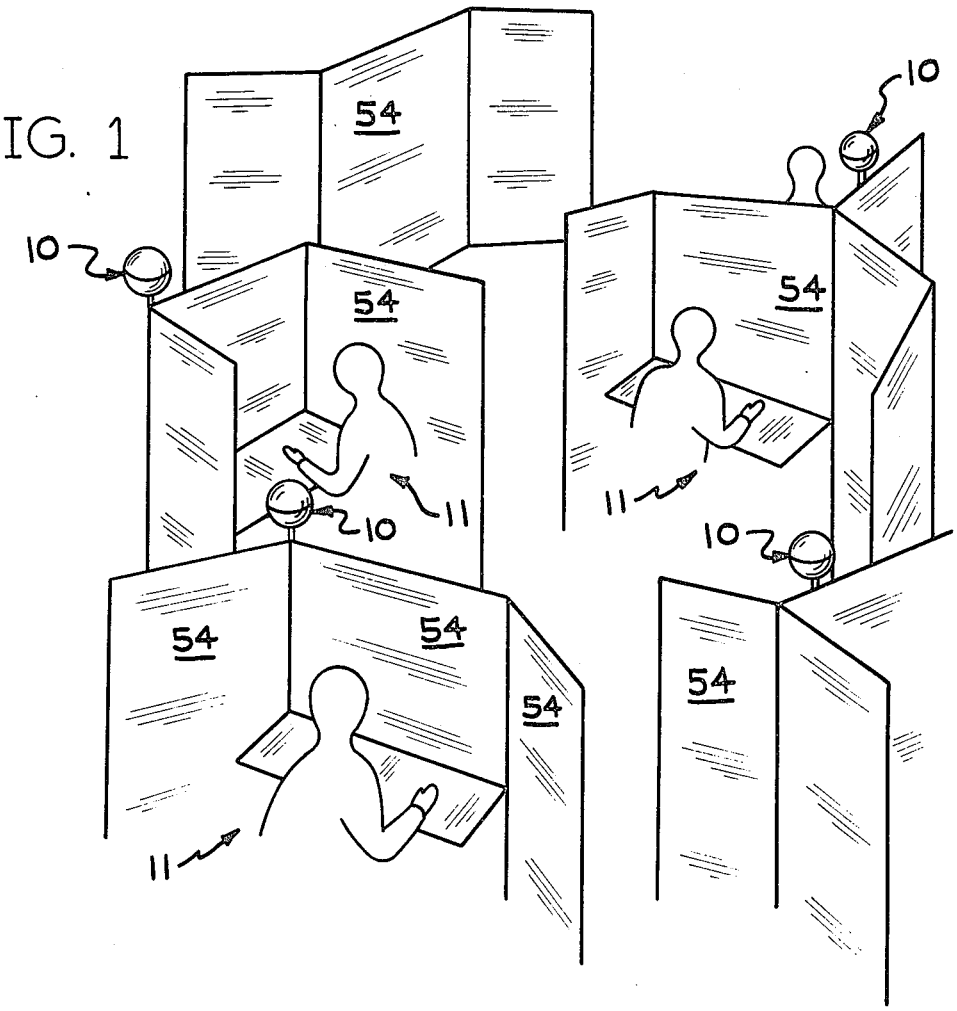
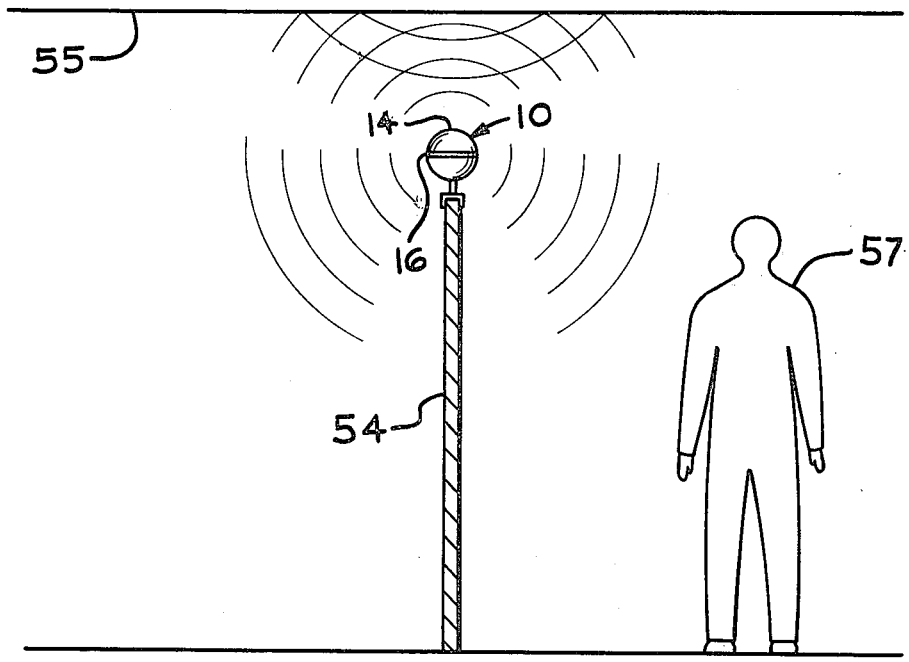
FIG. 2

MASKING SOUND GENERATOR

BACKGROUND OF THE INVENTION

Modern open plan offices are provided with work areas that are partitioned by panels which generally have a height less than the height of the ceiling. The panels and ceiling are sometimes acoustically engineered to absorb the vocal and machine noise attendant to common office activity, but not all of these sounds can be eliminated by acoustical engineering and so noise distraction remains a problem.

With respect to speech, it is not the loudness of the speech that causes the greatest distraction, but the fact that the speech can be understood. Thus, a sound system which can generate a masking sound signal which decreases the understandability of speech without itself becoming an annoyance or just background sound is desirable.

Effective masking sound systems have heretofore generally been designed specifically for the particular office area in which they are located and as such are costly. The majority of these systems are installed in the ceiling and become a permanent fixture of the office. This poses a special problem to users of office space, because in addition to the high installation cost, additional sums must be expended to tailor the sound system to area by area needs or to move the system if vacating the premises and even if it is removed, the system may not be adaptable to other office areas. Also, specially designed sound systems can involve high maintenance costs, since personnel trained in servicing such specially designed equipment may be difficult to find.

Portable sound masking devices are also known in the art. However, these devices produce a continuous sound spectrum which may be ineffective, monotonous and more annoying than the sounds that are masked.

Therefore, it is an object of the present invention to provide a self-contained masking sound generator unit which masks undesirable sounds found in the vicinity of the unit.

It is still a further object of the present invention to provide a masking sound generator which can be readily installed in various locations based on the need of the user.

It is still a further object of the present invention to provide a masking sound generator that can be adjusted by the user to conform to the specific sound signals present in the vicinty of the unit.

It is still a further object of the present invention to provide a masking sound generator that produces a sound signal having subtle wave variations to thereby provide a pleasant natural sound characteristic which effectively masks other sounds located in the vicinity of the unit.

SUMMARY OF THE INVENTION

The present invention provides a self-contained masking sound generator which effectively decreases the noticeability of speech and machine sounds present in an office area in the vicinity of the unit. The masking sound unit comprises a hollow enclosure having a top opening and a side opening. A speaker is mounted inside the enclosure intermediate the top opening and the side opening and faces outwardly from the unit through the top opening.

Electronic circuitry for producing the sound signal is installed in the unit and is operable to convert an electrical signal to an audible sound signal which can be emitted by the speaker. The circuitry in the illustrated embodiment includes a wave modulator to cyclically vary the amplitude of the sound signal, thereby giving it a natural sound characteristic of subtle wave amplitude.

The masking sound generator is most effectively used in a people-oriented office area where the unit is mounted at a height intermediate the ceiling of the room and the head of a standing adult person of average height. The unit is positioned so that the top opening faces upwardly to enable the speaker to direct sound signals upwardly to bounce off the ceiling to the listening area. Other sound signals are produced behind the speaker membrane due to the "backloading" effect of the membrane on the air behind it. These latter sound signals are emitted through the side opening and produce a pleasant and barely noticeable undertone that is compatible with the higher frequency sound signals emitted by the speaker through the top opening.

Stated otherwise, the speaker is controlled so that the sound directed upwardly therefrom is in the "high frequency" range, namely, a frequency in the 4,000–1,000 cycles per second range. By virtue of the backloading effect of the speaker membrane on the air behind it, a sound in the "low" frequency range will be emitted from the side opening in the enclosure. The higher the frequency of the sound emitted through the top opening, the greater the difference in frequency between this sound and the sound emanating through the side opening. In the present case, when the "high" frequency sound is in the 1,000 – 4,000 cycle per second range, the "low" frequency sound is in the 200 – 1,000 cycle per second range. In each case, the sound generator is adapted to the room situation. For example, the more sound absorbent the ceiling material, the higher the frequency sound must be to provide the desired sound masking effect.

The high and low frequency sound waves blend together to provide variable waves which blend together to give the effect of a single random background sound which masks other sounds. The masking sound generator of the present invention produces masking sound signals having subtle wave variation characteristics which effectively reduce the noticeability of speech and other sounds present in the vicinity of the unit. The masking sound generator of the present invention can be mounted in various manners such as on top of a panel of an office partition, on a wall or on such surfaces as a bookcase or a desk. In addition, external controls are provided to enable the user to vary the volume and frequency of the masking sound to conform to the user's needs.

Further objects, features and advantages of the present invention will become apparent from a consideration of the following description, the appended claims and the accompanying drawing in which:

FIG. 1 shows an office arrangement having work stations divided by panels on which a plurality of masking sound generators are mounted;

FIG. 2 shows a desirable location of the sound masking unit intermediate the ceiling and the head of an adult person of average height;

Figure 6:
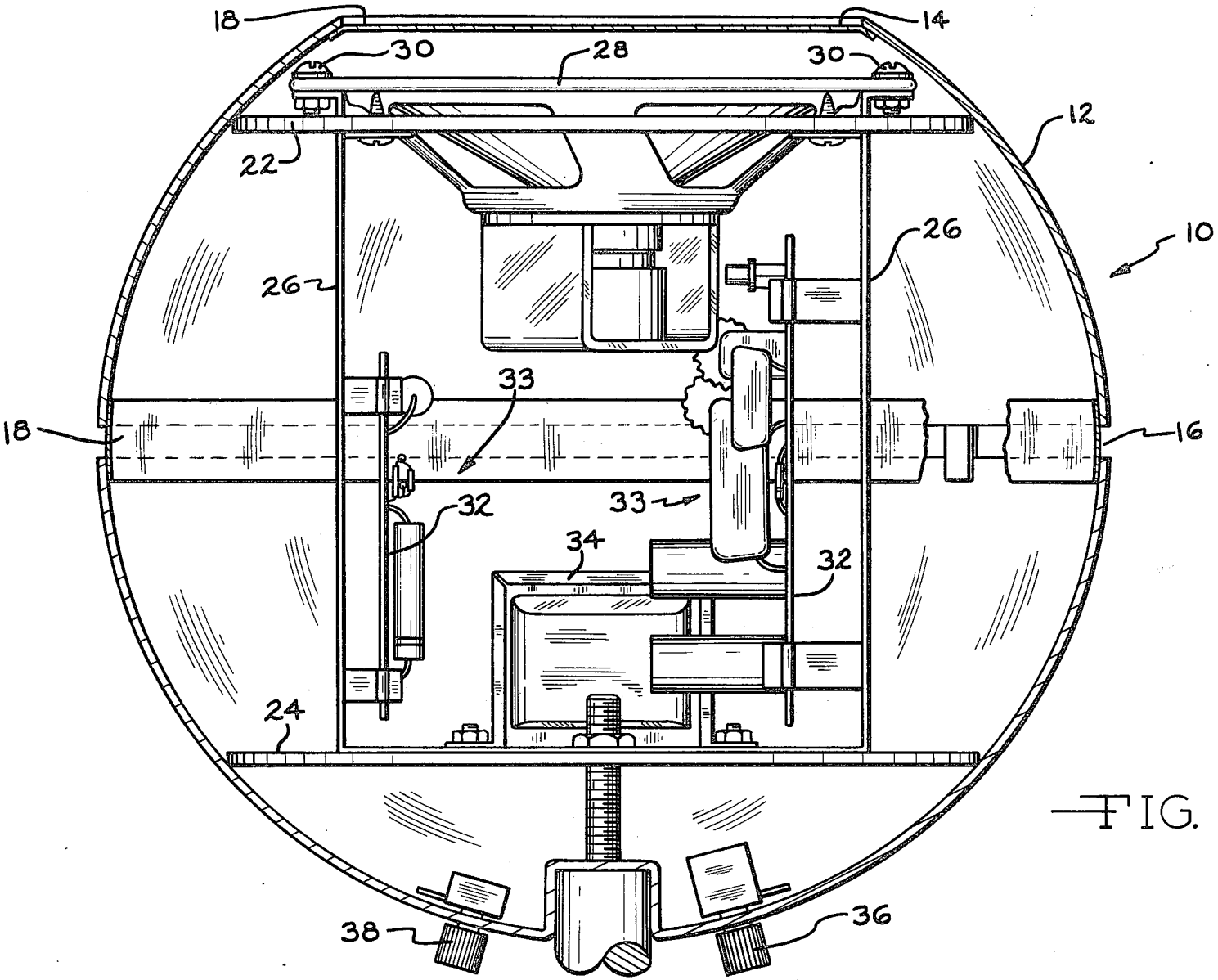
FIG. 6 is a side elevational view of the sound masking generator of this invention with the housing therefor broken away to show the components of the generator.

Referring to the drawing, a plurality of masking sound generators of this invention, indicated generally at 10, are shown in FIG. 1 associated with a plurality of office modules 11 which define individual activity zones within an otherwise open room enclosure. As shown in FIG. 6, a generator 10 consists of a hollow enclosure or housing such as the globular case 12 having a top opening 14 and a side opening such as the slot 16, which in the illustrated embodiment encircles the central portion of the globular case 12. Fabric covering 18 is provided to cover the top opening 14 and the slot 16 of the case 12 to protect the components therein from dust and add a pleasing appearance to the unit 10.

A top support brace 22 and a bottom support brace 24 are each mounted in a suitable manner in the case 12 to provide support for the components installed therein. A chassis 26 is affixed the support braces 22 and 24 and provides a frame on which the electronic circuitry is mounted. A speaker 28 is positioned on the chassis 26 and affixed thereto by the nut and bolt assemblies 30. As can be seen in FIG. 6, the speaker 28 is positioned in close proximity to the top opening 14 and intermediate the top opening 14 and the side opening 16 and faces outwardly from the unit 10 through the top opening 14. In operation of the unit 10, the speaker 28 emits a sound signal having an adjustable frequency through the top opening 14. As the speaker membrane vibrates, it pushes the air space directly below it in such a manner as to create a low frequency sound signal that is emitted directly through the slot 16. This low frequency noise is barely directionally noticeable and has a pleasant undertone compatible with the sound signals produced through the top opening 14.

A pair of electronic circuit component boards 32, on which the sound producing circuitry 33 is located, are each mounted to chassis 26. Thus, servicing of a defective unit can be accomplished by easy and quick replacement of a circuit board 32. A power transformer 34 is mounted on the chassis 26. An on-off volume control 36, rotatably mounted on the case 12, is connected (not shown for purposes of clarity) to one of the circuit boards 32 and allows the user to adjust the volume within a certain defined range. The volume control 36 cannot increase the sound intensity past the point at which masking sounds are part of the ambient background to insure that the unit 10 cannot be turned up to a volume which can be annoying to people in the area. A bass-treble control 38, mounted on the case 12, is connected (not shown) to a circuit board 32 to control, within a small range, the frequency of the sound signals to thereby accommodate the personal tastes and perceptions of the user.

Figure 7:
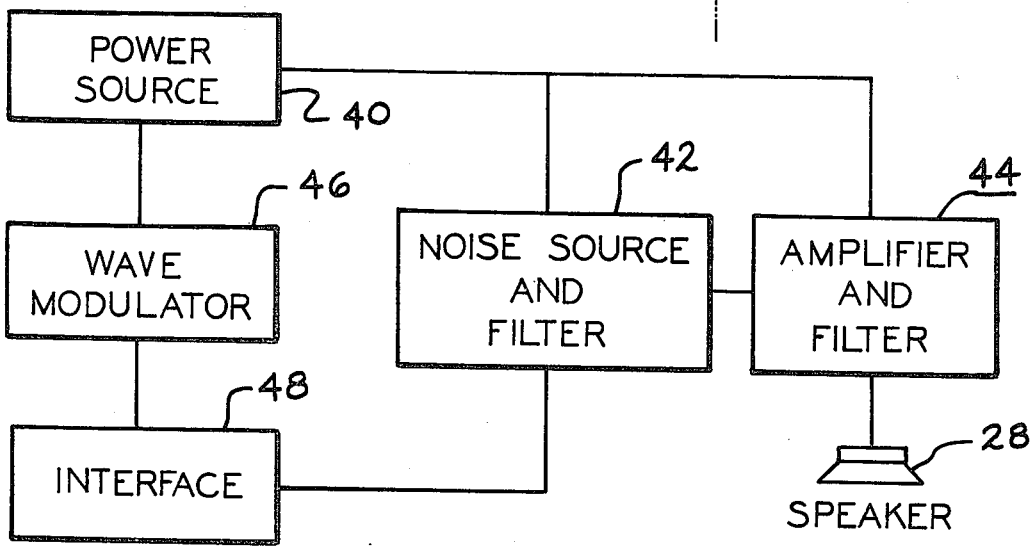
FIG. 7 is a block diagram of the circuitry in the masking sound generator of this invention.

The components of the electronic circuitry 33 are all solid state and transistorized to provide for continuous use without head build-up or frequency distortion. The circuitry 33 (FIG. 7) comprises a power source 40 connected to a noise source and filter 42 to produce an electronic signal which is amplified and filtered by the amplifier and filter 44 and converted to an audible sound signal by the speaker 28. In addition, the power source 40 drives a wave modulator 46 which is connected to the noise source and filter 42 by an interface 48 and which cyclically varies the amplitude of the sound signal emitted by the speaker 28.

In typical office setting, the unit 10 is set to produce a masking sound having an intensity of approximately 48 decibels which would cyclically be lowered to 44 decibels by the modulator. It should be noted that numbers used herein are merely representative and may be changed at will to adjust the unit 10 to the particular environment in which it is used. The unit 10 is set to operate at about 10 cycles per minute. Within each cycle the amplitude of the sound signal would be decreased to its low point 44 decibels and then be returned to its high normal sound intensity of 48 decibels. Thus, the amplitude variation of the sound signals gives the masking noise a nature "ebb and flow" which is characteristic of most random sounds.

The unit 10 operates most efficiently at a height intermediate the ceiling 55 of a room and the head of an adult person 57 of average height, as shown in FIG. 2. The unit 10 is mounted on one of the office module panels 54 with the top opening 14 facing in an upwardly direction to enable the sound signals emitted by the speaker 28 to deflect off the ceiling 55 to the general listening area. Low frequency sounds, being the result of the backloading effect, previously explained, radiate directly through the slot 16 and are evenly distributed into the listening area without any detrimental direct absorbtion by the ceiling.

Figure 3:
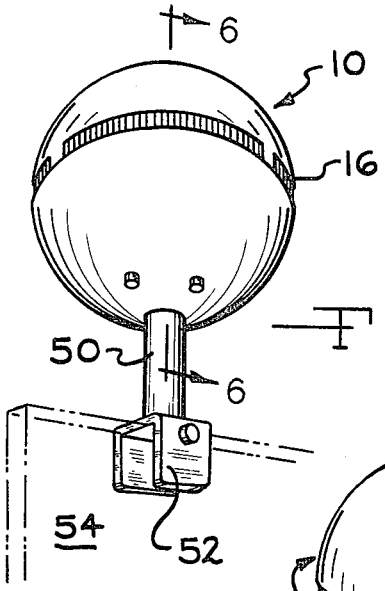
FIGS. 3–5 show various methods of mounting the masking sound unit.
Figure 4:
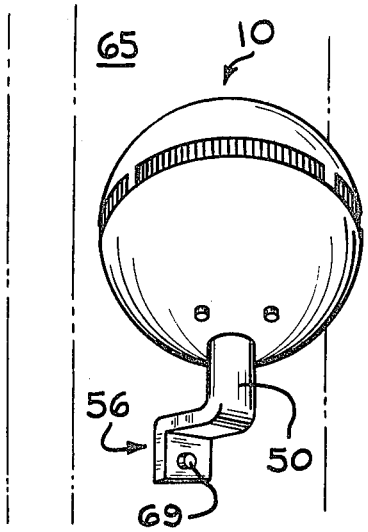
Figure 5:
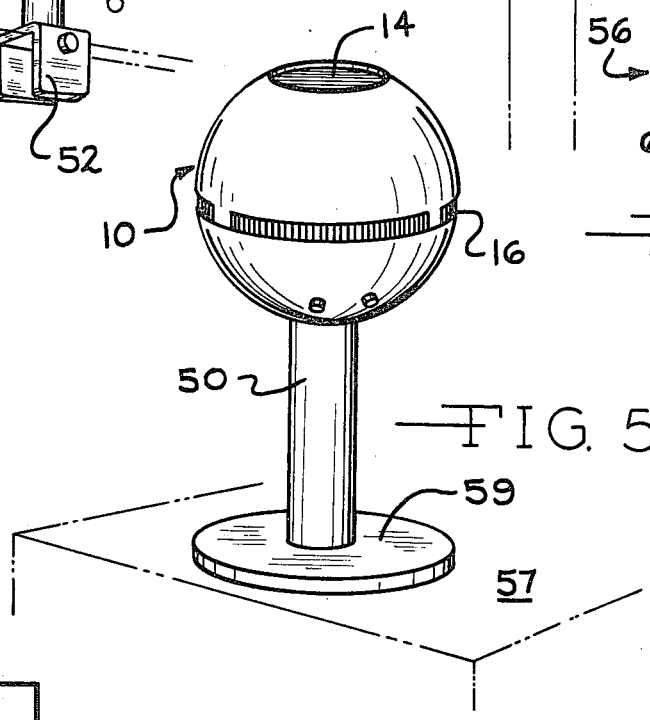

Various mountings for locating the unit 10 in suitable locations are shown in FIGS. 3–5. In FIG. 3, a sound masking generator 10 is illustrated in which the case 12 is secured to the upper end of a tubular stem 50 which is secured at its lower end to a mounting bracket 52 of inverted U-shape. The unit 10 of FIG. 3 can thus be readily mounted on a partition panel 54 by placing the bracket 52 in a position in which it straddles the upper end of the panel 54. FIG. 4 shows a unit 10 mounted on the upper end of a bent stem 50 which is formed at its lower end with an upright plate portion 56 which is placed against a wall 65 and secured thereto by suitable means such as the bolt 69. Finally, FIG. 5 shows a unit 10 attached to the upper end of the stem 50 which is provided at its lower end with a flat base 59. The FIG. 5 unit 10 can then be supported directly on a flat supporting surface such as the one shown at 57. It is readily apparent that one of the virtues of this invention is its capability of being positioned in any suitable location to accommodate the needs of the user. In addition, renters of office space can readily move their sound system to a new location upon vacating the premises.

In operation, the sound masking generators 10 can be positioned throughout an office area such as shown in FIG. 1 where work areas 11 are partitioned by panels 54. The units 10 are mounted on top of the panels 54 so that they are in the space between the ceiling 55 and the heads of the people using the modules. When the units 10 are placed in a group, as shown in FIG. 1, their sound signals overlap and a masking sound, having a random pitch characteristic, is produced which is the result of the individual sounds of each unit 10 and which has a pleasant and natural quality.

Each unit 10 can be adjusted by the user to fit the particularly sound environment that exists in the area of the unit 10. If, for example, the external sounds are of a low frequency such as that of air rushing through a ventilation system, the user may desire to adjust the bass-treble control 38 increasing the high thereby providing for an adequate blend of high and low frequencies. If, on the other hand, the external sound signals have high frequency such as that of certain machines, the user may adjust the bass-treble control 38 so that a balancing sound is emitted to blend the high and low frequencies thereby effectively masking the undesired sounds.

It can thus be seen that a masking sound generator 10 is provided having a speaker 28 mounted in a case 12 intermediate its top opening and side opening to face outwardly through the top opening. The unit 10 is positioned at a height intermediate the ceiling and the head of a standing adult and sound signals having a subtle pitch variation are emitted from the top opening 14 and the side opening 16 to effectively reduce the annoyance from external sounds present in the vicinity of the unit 10.

What is claimed is:

1. In combination with a room having a ceiling and being adapted for use by adult persons of average height, sound generating apparatus for producing sound signals which mask other sounds present in said room, said apparatus comprising a hollow enclosure having a top opening and a side opening through which sound signals are emitted, a speaker mounted in said enclosure intermediate said top opening and said side opening, said speaker being positioned to face outwardly from said enclosure through said top opening, circuit means disposed in said hollow enclosure for developing an electrical signal that is converted to an audible sound signal emitted by said speaker, said apparatus being positioned at a height intermediate the head of a standing adult person and the ceiling so that said top opening faces in an upwardly direction.

2. Apparatus according to claim 1 wherein said circuit means includes modulation means operable to vary the amplitude of said sound signal being emitted by said speaker.

3. Apparatus according to claim 1 further including a volume control, and a bass and treble control connected to said circuit means to enable said apparatus to be adapted to specific sounds present in said room.

4. Apparatus according to claim 2 wherein said hollow enclosure is a globular case, and wherein said side opening comprises a narrow slot formed to substantially encompass said case, said speaker being mounted in said case intermediate said top opening and said slot.

5. Sound generating apparatus for producing sound signals having different frequencies which mask sounds present in the vicinity of said apparatus, said apparatus comprising a hollow enclosure having top and bottom ends, means forming an opening in said hollow enclosure at the top end thereof through which sound signals having a relatively high frequency can be transmitted, and means forming a side opening in said hollow enclosure between said top and bottom ends through which sound signals having a relatively low frequency can be transmitted, said side opening extending substantially entirely around said hollow enclosure so that said low frequency signals are transmitted simultaneously with said high frequency signals in a plurality of directions away from said hollow enclosure, speaker means mounted in said enclosure intermediate said openings, said speaker means facing upwardly toward said top opening, and circuit means disposed in said enclosure, said circuit means including means for developing an electrical signal having an amplitude that varies within a predetermined range, said electrical signal being converted to an audible signal by said speaker means.

6. Apparatus according to claim 5 wherein said circuit means includes modulation means operable to vary the amplitude of said sound signal being emitted by said speaker.

7. Apparatus according to claim 6 further including a volume control, and a bass and treble control connected to said speaker.

8. Apparatus according to claim 7 wherein said hollow enclosure is a globular case.

9. Apparatus according to claim 8 wherein said side opening is a slot which substantially encircles said globular case intermediate the upper and lower ends thereof.

* * * * *